United States Patent [19]

Detsch

[11] Patent Number: 4,702,593

[45] Date of Patent: Oct. 27, 1987

[54] DENTAL DIAGNOSTIC METHOD

[76] Inventor: Steven G. Detsch, 4840 Casa Bonita Ct., Bonita, Calif. 92002

[21] Appl. No.: 840,590

[22] Filed: Mar. 17, 1986

Related U.S. Application Data

[63] Continuation-in-part of Ser. No. 603,822, Mar. 25, 1984, abandoned.

[51] Int. Cl.[4] ..... G03G 13/04

[52] U.S. Cl. ..... 355/77; 355/3 R; 355/67

[58] Field of Search ..... 355/3 R, 67, 68, 69, 355/77

[56] References Cited

U.S. PATENT DOCUMENTS

| | | | |
|---|---|---|---|
| 2,107,074 | 2/1938 | Hineline | 355/70 X |
| 3,152,528 | 10/1964 | Pendry | 355/3 R |
| 3,402,636 | 9/1968 | Gemmer et al. | 355/68 |
| 3,431,051 | 3/1969 | Tosti | 355/3 R X |
| 3,526,459 | 9/1970 | Elmer | 355/67 |
| 3,597,071 | 7/1971 | Jones | 355/3 R |
| 3,743,405 | 7/1973 | Morse et al. | 355/68 X |
| 4,027,962 | 6/1977 | Mailloux | 355/3 R X |
| 4,120,580 | 10/1978 | Mailloux | 355/3 R X |

*Primary Examiner*—Fred L. Braun

*Attorney, Agent, or Firm*—Michael W. York

[57] ABSTRACT

A method for using a conventional electrostatic type copier to copy medical x-ray negative transparencies that involves the steps of providing a movable source of light external to the copier, a movable light diffuser locatable between the source of light and the copying surface of the copier and providing apparatus for adjusting the light illuminance at the copying surface of the copier. The method then involves the steps of locating the medical x-ray negative on the copying surface of the copier and illuminating the medical x-ray negative with light which passes through the movable light diffuser with the illuminance at the copying surface of the copier being between the predetermined limits of about 950 foot candles and about 1,425 foot candles while making a copy of the medical x-ray negative with the copier.

6 Claims, 5 Drawing Figures

DENTAL DIAGNOSTIC METHOD

CROSS REFERENCE TO RELATED APPLICATION

This application is a continuation in part of U.S. patent application Ser. No. 06/603,822 filed Mar. 25, 1984, now abandoned.

BACKGROUND OF THE INVENTION

Dental x-rays have proven to be very useful in diagnosing various types of dental defects and diseases. For instance, such x-rays have been useful in locating hidden carries, diseased teeth roots and the like. Indeed through the use of such x-rays dentists have been able to determine the position of nonerupted teeth located within the jaw bone.

Normally these x-rays are taken by the dentist in his office and then used to determine the subsequent treatment that should be given in the same office. In such cases the original x-ray film that is usually in the form of a nonenlarged negative is all that is necessary. However, it is not unusual for there to be a need for at least one additional copy of the x-ray negative for diagnostic purposes. For instance, such a copy may be required by the patient's insurance company to document or confirm the dentist's diagnosis. In addition, it is not unusual to have a need to transmit a copy of an x-ray negative to another dentist. The duplication of such x-ray negatives requires expensive equipment and is time consuming and inconvenient. In addition, it usually is necessary to remove the original negative from the dentist's office for this to be accomplished and this can result in the original x-ray negative being mislayed or lost.

Consequently, a definite need exists to be able to inexpensively duplicate dental x-ray negatives and the like. It would also be desirable for this to be accomplished in the dentist's office so that the original x-ray negative could remain in his office and be available for use. In addition, a need exists for the dentist to be able to readily transmit a copy of this x-ray negative to a person that may be located some distance from his office.

The well known and extensively used electrostatic type copiers such as those identified by the trademark Xerox are very good at copying such items as typed pages and the like where the background is predominately light and there is a rather sharp distinction between the light background and the typed or printed letters. However, when one attempts to copy some picture or the like that has a dark background or where the background is not predominantly white the copy is usually very poor. This is also the case where there is no sharp distinction between adjacent portions of the picture or the like. These adverse characteristics of such electrostatic type copiers make them unsuitable for copying pictures and the like for medical or dental diagnositc purposes. In particular, they are not suitable for copying dental x-ray negatives for diagnostic purposes since usable dental x-ray negatives or copies of the same must show clear and sharp images. It is unfortunate that the electrostatic copier cannot copy x-ray negatives for dental diagnostic purposes since such copiers are usually located in or near most dental offices in the United States and hence they are readily available for use.

Recently an x-ray duplicator has been introduced that uses duplicating film that uses a wet system that must be processed in water with a fixer and a developer. The film for such a system is also very expensive. Consequently, such a system in inconvenient, expensive and difficult to use.

This invention satisfies the need to be able to inexpensively duplicate dental x-ray negatives and the like and allows this to be easily accomplished utilizing existing electrostatic copying equipment without the need to modify this equipment. Moreover, the quality of the copies produced is very good and the copies can be readily used for dental diagnostic and other purposes.

SUMMARY OF THE INVENTION

This invention relates to dental diagnostic methods and more particularly to methods for copying dental x-ray negatives.

Accordingly, it is a primary object of the invention to provide a copying apparatus and a method for clearly copying transparencies.

It is an object of the invention to provide a copying method for clearly copying dental transparencies.

It is also an object of the invention to provide a method for clearly copying dental x-ray negatives.

It is also an object of the invention to provide a method for permitting copies of transparencies to be readily transmitted to a remote location.

It is also an object of the invention to provide a method for transmitting copies of medical transparencies to remote locations.

It is also an object of the invention to provide a copying method for transmitting copies of dental transparencies and the like such as copies of x-ray negatives to remote locations.

The present invention provides a copying method for clearly copying transparencies. The method involves providing a conventional electrostatic copier and a source of light, locating the source of light at a desired location exterior to the electrostatic copier and causing the light source to emit light toward the copying surface of the electrostatic copier when it is desired to make copies of the transparencies. The method also includes using a diffusing member and adjusting the light intensity between predetermined limits.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 1:
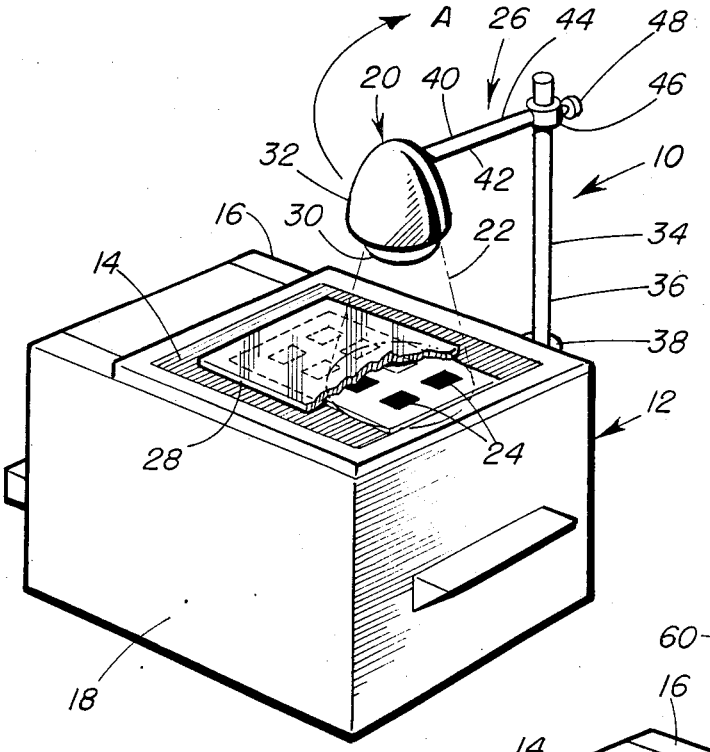
FIG. 1 is a perspective view of the dental x-ray negative copying apparatus used with the present invention.

Referring first to FIG. 1, one embodiment of the copying apparatus for copying transparencies such as x-ray negatives is illustrated and is designated generally by the number 10. The copying apparatus for copying transparencies 10 comprises an electrostatic type copier 12 which is well known in the art. The electrostatic type copier 12 uses a fixed light source with a copying surface 14 that is located on the upper surface 16 of the housing 18 of the electrostatic type copier 12. The copying apparatus for copying transparencies 10 also comprises a source of light located exterior to the copier 12. This source of light is designated generally by the number 20. The copying apparatus for copying transparencies 10 also comprises means for locating the source of light 20 to permit the source of light to project light 22 upon a transparency such as the dental x-ray negatives 24 laying upon the copying surface 14 of the copier 12 that is designated generally by the number 26 and the light diffusing means comprising a flat thin generally rectangular shaped opaque acrylic plate or sheet 28 that is located on top of the transparency 24 between the transparency and the light source 20.

The source of light 20 comprises a 500 watt photo flood light bulb 30 that is screwed into a combination light bulb receptacle and light bulb shade or shield 32. The locating means 26 comprises a rod or pole 34 that projects upward substantially vertical to the plane of the copying surface 14. The lower portion 36 of this pole 34 may be connected to the adjacent side of the copier 12 by means of the bracket 38. The locating means 26 also includes the substantially horizontally located projecting member 40 whose outer end portion 42 is rigidly connected to the light shade 32 and whose inner end portion 44 is rigidly affixed to a mounting ring 46.

A thumb screw 48 is located on the mounting ring 46 to permit the mounting ring to be slid up and down the pole. This thumb screw 48 and associated ring 46 comprise means for varying or adjusting the intensity of the light 22 impinging upon the transparencies 24 since it permits the distance from the light source 20 and the transparency 24 to be varied. The ring 46 and thumb screw 46 also permit the light source 20 and the projecting member 40 to be swung or pivoted out of the way such as in the direction illustrated by the letter A when the copier 12 is to be used in a conventional manner without a transparency 24. Of course, the diffusing means or plate 28 would also be removed by hand by lifting it off of the transparency 24 and copying surface 14 when using the copier 12 in a conventional manner.

The electrostatic copier 12 is well known in the art and is readily available from various manufacturers. This type of copier 12 uses a fixed internal light source that is not shown. Since the copier 12 is well known in the art it is not described in detail.

Figure 2:
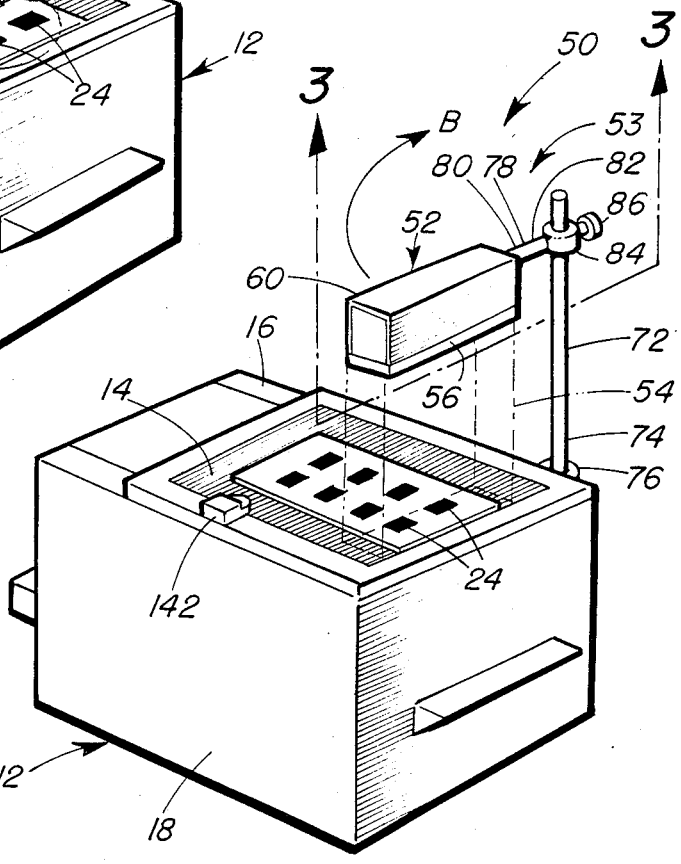
FIG. 2 is a perspective view of another embodiment of the apparatus illustrated in FIG. 1.

Another embodiment of the copying apparatus for copying transparencies such as x-ray negatives is illustrated in FIG. 2 and is designated generally by the number 50. The same electrostatic type copier 12 is illustrated in FIG. 2 as in FIG. 1 and it has the same copying surface 14 located on its upper surface 16 of the housing 18 and it uses a fixed internal light source. Transparencies in the form of dental x-ray negatives 24 are illustrated in FIG. 2 and are located upon the copying surface 14.

The copying apparatus for copying transparencies such as dental or x-ray negatives 50 comprises a source of light located exterior to the copier 12 that is designated generally by the number 52 and means 53 for locating the source of light 52 to project light 54 upon a transparency such as the dental x-ray negatives 24. The copying apparatus for copying transparencies 50 also comprises light diffusing means comprising a flat thin generally rectangular shaped opaque acrylic plate or sheet 56 that is located adjacent to the light source 52 between the transparencies 24 and the light source 52.

Figure 3:
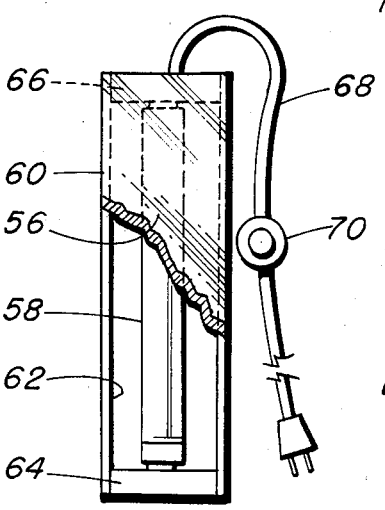
FIG. 3 is a view of a portion of the structure illustrated in FIG. 2 taken in the direction of the line 3—3 thereof.

As illustrated in FIGS. 2 and 3, the light source 52 comprises an elongated incandesent light bulb 58 that is surrounded by a substantially rectangular shaped housing 60. As best illustrated in FIG. 3, one side, the lower side, is open and hence has an aperture 62 for permitting light to exit the housing 60. As illustrated in FIG. 3, connecting means 64 and 66 are located within the housing at each end of the housing 60 for electrically connecting the light bulb 58 to a source of electrical power (not shown) through the use of the electrical power cord 68 illustrated in FIG. 3.

The electrical power cord 68 has a reostat or variable resistor 70 connected to it that comprises electrical means for varying or adjusting the intensity of the light 54 impinging upon the transparencies 24 that are located on the copying surface 14 of the copier 12. The variable resistor 70 permits the electrical power to the bulb 58 to be varied that in turn will vary the light 54 that impinges upon the transparencies 24.

The means 53 for locating the source of light 52 comprises a rod or pole 72 that projects upward substantially vertical to the plane of the copying surface 14. The lower portion 74 of this pole 72 can be connected to the side of the copier 12 by means of the bracket 76 that is similar to the bracket 38 illustrated in FIG. 1. The locating means 53 also includes a substantially horizontally located porjecting member 78 whose outer end portion 80 is rigidly connected to the housing 60 and whose inner end portion 82 is rigidly affixed to a mounting ring 84 that surrounds the pole 72. A thumb screw 86 is located on the mounting ring 84 to permit the mounting ring 84 to be slid up and down on the pole 72. This thumb screw 86 and associated mounting ring 84 comprise means for mechanically varying or adjusting the intensity of the light 54 impinging upon the transparencies 24 since they permit the distance from the light source 52 to the transparencies 24 to be varied.

The mounting ring 84 and the associated thumb screw 86 also serve as means to permit the light source 52 to be swung or pivoted out of the way such as in the direction indicated by the letter B when the copier 12 is to be used in a conventional manner without a transparency or transparencies 24. When needed the light source 52 can be swung back into its in use position as illustrated in FIG. 2. Of course, the same is true with respect to the light source 20 of the embodiment illustrated in FIG. 1.

It will be noted that the copiers 12 illustrated in FIGS. 1 and 2 are of the fixed internal light source type that have a movable copying surface or platen 14 that moves horizonally along the upper surface 16 of the copier 12. This type of copier 12 is in wide use throughout medical and dental offices since it is relatively inexpensive and yet produces satisfactory copies. These copiers 12 are designed to have their copying surfaces such as the surface 14 shielded from outside light while they are making copies since with light external to the copier 12 or external light impinging upon the item to be copied the copier 12 produces poor copies. Consequently, the copier 12 is not designed to work satisfactorily in what is termed a back lighting system such as that illustrated in FIGS. 1 and 2 or a system in which light external to the copier is supplied to the copier's copying surface. In view of this situation it would appear that such a system as illustrated in FIGS. 1 and 2 would not work satisfactorily.

Unexpectedly, it has been discovered that such a system as illustrated in FIGS. 1 and 2 does work very effectively with x-ray transparencies provided a light diffuser such as that designated by the number 28 or 56 is utilized and the light illumination at the copying surface 14 or the copier 12 is controlled. Through a number of experiments using fixed light source office type copiers such as the copier 12 it has been determined that the illumination at the copying surface 14 of the copier 12 from the external source of light such as the light 30 or 58 should be at least about 950 foot candles when the x-ray film transparency is copied by the copier. If the illumination is lower than about 950 foot candles this produces unacceptable copies that are apparently underexposed or the result of underexposure. In a similar manner it has been unexpectedly determined experimentally that the light illumination at the copying surface 14 of the copier 12 from the external source of light such as the light 30 or 58 should not be more than about 1,425 foot candles when the x-ray film transparencies are copied by the copier 12 or the copies will be unsatisfactory and apparently the result of over exposure.

The reason for the satisfactory operation of the copier 12 with the illuminance mentioned is not completely understood. Apparently, since the copier 12 is designed to operate only with internal illumination including the reflection from the copier's copying surface due to the internal light source, the copier senses the additional diffused light caused by the external light within the about 950 to about 1,425 foot candle limits at the copier 12 copying surface 14 as being part of the expected or acceptable reflected light. Tests with transparencies other than x-ray film transparencies with the illuminance range mentioned did not produce satisfactory results.

The tests were conducted with various makes of office type copiers including a Minolta EP-310 copier. The diffusing plate that was used as the part designated as 28 in FIG. 1 and 56 in FIG. 2 was made from the material used in standard light boxes which is substantially three milimeters in thickness and as stated previously generally comprises an opaque material. However, due to the relative thinness of the material it transmits some light and hence is really semi-opaque or semi-transparent. Consequently, any reference to opaque herein means semi-transparent or semi-opaque due to the relative thinness of the material.

The method of the invention is practiced in the following manner. A copier such as the copier 12 is provided. An external light source such as the light source 20 or 52 is also proyided. These light sources are constructed in a conventional manner that is well known to those skilled in the art. A light diffuser such as the appropriate light diffuser 28 or 56 is appropriately cut or formed to provide a substantially rectangular sheet of plastic or opaque material such as an acrylic plastic. The transparency or transparencies such as a dental x-ray film transparency or transparencies 24 is or are also provided. This is represented by a block with the number 116 in FIG. 4.

The next step in practicing the method is to place the transparency or transparencies 24 on the copying surface 14 of the appropriate copier 12 as indicated by the block numbered 118 in FIG. 6. The next step as indicated by the block numbered 120 in FIG. 6 is to locate the external light source 20 or 52 in position to illuminate the appropriate transparency or transparencies 24. The light diffuser such as the diffuser 28 or 56 is located between the light source such as the light located between the light source such as the light source 20 or 52 and the transparency or transparencies 24 as designated by the numbered block 122 in FIG. 4.

Figure 4:
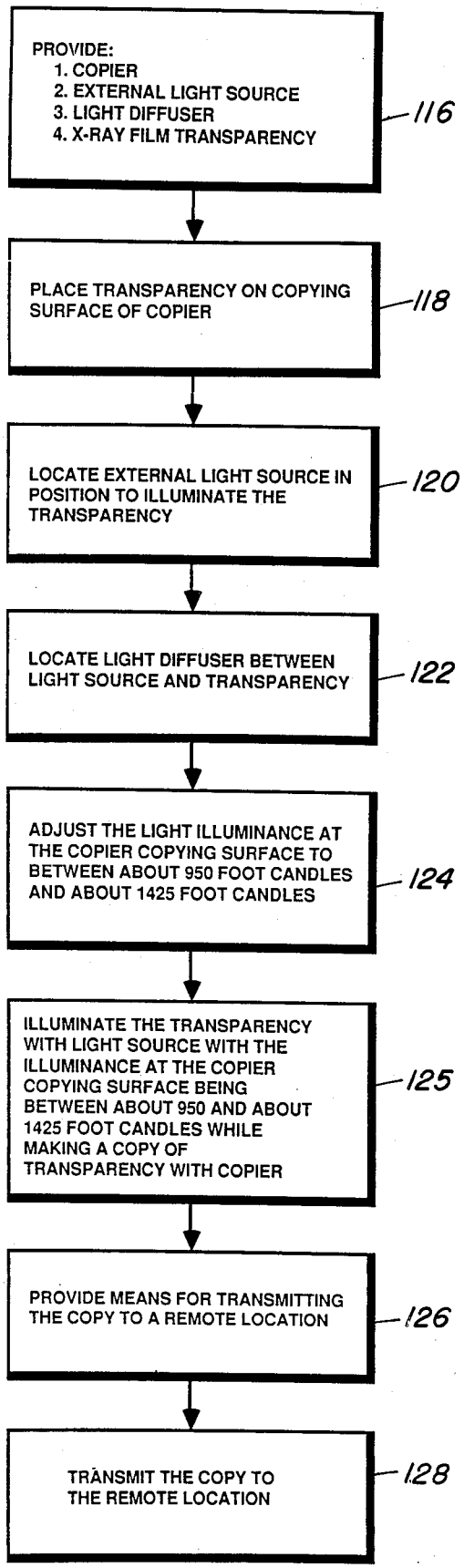
FIG. 4 is a block diagram illustrating the manner of carrying out the method for copying dental x-ray negatives.

The next step as indicated in the block numbered 124 in FIG. 4 is to adjust the light illuminance at the copying surface 14 of the copier 12 caused by light from the external light source 20 or 52 that passes through the light diffuser 28 or 56 so that the illuminance at the copying surface 14 of the copier 12 is between about 950 foot candles and about 1,425 foot candles. This can be done by adjusting the distance of the light source 20 or 52 from the copying surface 14 of the copier 12 using the means for adjusting the light intensity comprising the thumb screw 48 and mounting ring 46 of FIG. 1 or comprising the thumb screw 86 and mounting ring 84 of FIG. 2 which permit the light source 20 or 52 to be located at various locations along the pole 34 or 72. The illuminance can be determined using a suitable light meter in a manner known to those skilled in the art.

The next step as indicated in the block numbered 125 in FIG. 4 is to illuminate the transparency or transparencies 24 with light from the external light source 20 or 52 with the light first passing through the light diffuser 28 or 56 prior to impinging upon the transparency or transparencies 24 with the illuminance at the copying surface 14 of the copier being between about 950 foot candles and about 1,425 foot candles. Simultaneously, the copier 12 is operated in a conventional manner to produce a copy or copies of the transparency or transparencies 24 on the copying surface 14.

The copy or copies of the transparency or transparencies 24 can then be used locally such as by filing them. However, in many instances, it would be desired to transmit them to some remote location such as to a dentist's office in a distant city. In this case the next step as indicated in the block numbered 126 in FIG. 6 is to provide means for transmitting the copy of the transparency or transparencies 24 to the remote location. This could be a telecopier, courier service, etc. The next step as indicated by the block numbered 128 in FIG. 6 is to actually transmit the copy or copies to a remote location.

The invention can be used in connection with a kit to retrofit existing electrostatic type copiers such as the copier 12. In this case a kit including the light source 20 and the locating means 26 including the projecting member 40, pole 34, mounting ring 46, thumb screw 48 and the bracket 36 illustrated in FIG. 1 and the diffusing plate 28 would be provided in kit form to retrofit an existing copier 12. In order to use the retrofit kit holes would only have to be drilled in the side of the copier 12 so that the bracket 38 could be attached to the side of the copier 12 in a conventional manner by appropriate screws (not shown). The end 36 of the pole 72 would then be located within the bracket 76 and tightened in place. The invention would then be utilized in the previously described manner.

The equipment illustrated in FIGS. 2 and 3 can also be used in the form of a retrofit kit to retrofit copiers such as the copier 12. In this case, a kit including the light source 52 and the locating means 53 that include respectively the housing 60, cord 68 with its reostat 70 and the pole 72, projecting member 78, mounting ring 84, thumb screw 86 and bracket 76 would be provided to retrofit an existing copier 12. Retrofitting would be accomplished by connecting the bracket 76 to the side of the copier 12 by drilling holes for screws and then mounting the bracket 76 to the side of the copier 12 by screws (not shown) in a conventional manner and the end portion 74 of the pole 72 would be located in the bracket 76 and the bracket 76 would be tightened around the end portion 74. The equipment would then be utilized in the previously described manner.

Figure 5:
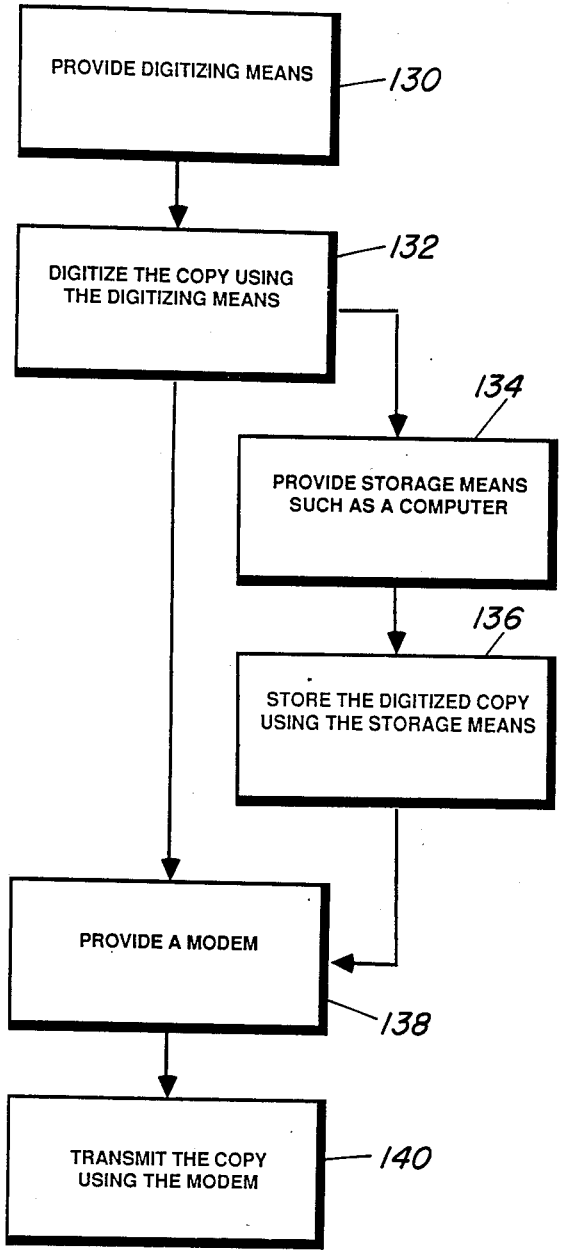
FIG. 5 is a block diagram illustrating further uses for the dental x-ray negative copying apparatus and the manner of carrying out the method for copying dental x-ray negatives.

Further steps in the practice of the method of the invention are illustrated in FIG. 5. After the step designated by the number 125 in FIG. 4 in which a copy of the x-ray transparency is made it can then be digitized. In order to do this as indicated in FIG. 5 digitizing means are provided as designated by the number 130. The next step is to digitize the x-ray transparency copy as designated by the number 132. If it is desired for the digitized x-ray copy to be stored for future use then the next step as indicated by the number 134 is to provide a storage means such as a computer and then to store the digitized x-ray copy as indicated by the next step designated by the number 136.

As indicated in FIG. 5 after the digitizing step 132 or the storage step 136 the digitized x-ray copy or the stored x-ray copy can be transmitted by first providing a MODEM or a modulator/demodulator as indicated by the step designated 138. The next step is to actually transmit the copy of the x-ray transparency using the MODEM as indicated by the step designated by the number 140.

It should be understood that the word transparency as sometimes used herein is also meant to include transparencies such as the multiple transparencies in a dental x-ray card since in actuality there are a plurality of dental x-ray negatives or transparencies on one single x-ray card. The previously described determination of illuminance is accomplished as illustrated in FIG. 2 by placing a suitable light meter designated by the number 142 with its light sensing portion immediately adjacent the copying surface 14 of the copier 12. The light meter 142 must be operated and observed while the illuminance at the copying surface is adjusted to between about 950 foot candles to about 1,425 foot candles by adjusting the distance of the light source 20 or 52 from the light copying surface 14. In the case where the diffusing member 28 is located adjacent the copying surface 14 such as in FIG. 1 the light sensing portion of the light meter 142 must be slipped under the diffusing member 28 to obtain appropriate readings.

Although the invention has been described in considerable detail with reference to certain preferred embodiments, it will be understood that variations and modifications may be made within the spirit and scope of the invention as defined in the appended claims.

What is claimed is:

1. A method for using a conventional electrostatic type copier to copy medical x-ray negative transparencies comprising the steps of:

providing an electrostatic type copier having a copying surface;

providing a movable source of light external to said electrostatic type copier and movable light diffusing means locatable between said external movable source of light and the copying surface of said electrostatic type copier;

providing means for adjusting the light illuminance at the copying surface of said electrostatic copier from light provided from said movable light source after said light passes through said movable light diffusing means;

*adjusting the light illuminance at the copying surface* of said electrostatic type copier between the predetermined limits of about 950 foot candles and about 1,425 foot candles;

locating a medical x-ray negative on the copying surface of said electrostatic type copier; and illuminating said medical x-ray negative with light from said movable source of light which passes through said movable light diffusing means with the illuminance at the copying surface of said copier being between said predetermined limits of about 950 foot candles and about 1,425 foot candles while making a copy of said medical x-ray negative with said electrostatic type copier.

2. The method for using a conventional electrostatic type copier to copy medical x-ray negative transparencies of claim 1 further comprising the steps of:

providing means for moving said movable source of light and said movable light diffusing means between at least two positions with one of said positions permitting said electrostatic type copier to be used to copy medical x-ray negatives and another of said positions permitting said electrostatic type copier to be used in a conventional copying manner without medical x-ray negatives; and moving said movable source of light and said movable light diffusing means into position to permit said electrostatic type copier to be used to copy medical x-ray negatives when it is desired to copy medical x-ray negatives.

3. The method for using a conventional electrostatic type copier to copy medical x-ray negative transparencies of claim 1 further comprising the steps of providing means for transmitting copies of said medical x-ray negatives made by said electrostatic type copier to a remote location and transmitting the copies of said medical x-ray negatives to the remote location through the use of said copy transmitting means.

4. The method for using a conventional electrostatic type copier to copy medical x-ray negative transparencies of claim 3 wherein said step of providing means for transmitting copies of said medical x-ray negatives comprises the step of providing digitizing means and providing a MODEM.

5. The method for using a conventional electrostatic type copier to copy medical x-ray negative transparencies of claim 4 wherein said step of transmitting copies of said medical x-ray negatives comprises the step of using said digitizing means to digitize copies of medical x-ray negatives and transmitting digitized copies of said medical x-ray negatives through the use of said MODEM.

6. The method for using a conventional electrostatic type copier to copy medical x-ray negative transparencies of claim 5 further comprising the steps of providing storage means for storing said digitized copies of said medical x-ray negatives and storing said digitized copies of said medical x-ray negatives prior to transmitting said digitized copies through the use of said MODEM.

* * * * *